US007086461B2

(12) United States Patent
Schulze-Beckinghausen et al.

(10) Patent No.: US 7,086,461 B2
(45) Date of Patent: Aug. 8, 2006

(54) COMBINED GRIP CONTROL OF ELEVATOR AND SPIDER SLIPS

(75) Inventors: Joerg Erich Schulze-Beckinghausen, Garbsen (DE); Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 205 days.

(21) Appl. No.: 10/399,998

(22) PCT Filed: Nov. 5, 2001

(86) PCT No.: PCT/GB01/04911

§ 371 (c)(1),
(2), (4) Date: Oct. 10, 2003

(87) PCT Pub. No.: WO02/36927

PCT Pub. Date: May 10, 2002

(65) Prior Publication Data

US 2004/0188098 A1 Sep. 30, 2004

(30) Foreign Application Priority Data

Nov. 4, 2000 (GB) ..... 0026997.7
Jul. 2, 2001 (GB) ..... 0116170.2

(51) Int. Cl.
*E21B 19/06* (2006.01)

(52) U.S. Cl. ..... 166/77.53

(58) Field of Classification Search ..... 166/77.1, 166/77.4, 77.51, 77.52, 77.53
See application file for complete search history.

(56) References Cited

U.S. PATENT DOCUMENTS

| | | | | |
|---|---|---|---|---|
| 3,906,813 | A * | 9/1975 | Webber et al. | 74/473.11 |
| 4,042,123 | A | 8/1977 | Sheldon et al. | 414/22.71 |
| 4,676,312 | A | 6/1987 | Mosing et al. | 166/77.53 |
| 5,791,410 | A * | 8/1998 | Castille et al. | 166/77.1 |
| 6,386,282 | B1 * | 5/2002 | Jansch | 166/53 |
| 6,626,238 | B1 * | 9/2003 | Hooper | 166/66 |

FOREIGN PATENT DOCUMENTS

| | | |
|---|---|---|
| EP | 1 099 824 | 5/2001 |
| WO | 9404788 | 3/1994 |
| WO | 9831914 | 7/1998 |
| WO | 9900577 | 1/1999 |

* cited by examiner

*Primary Examiner*—David Bagnell
*Assistant Examiner*—Daniel P Stephenson
(74) *Attorney, Agent, or Firm*—Patterson & Sheridan, LLP

(57) ABSTRACT

Apparatus for gripping and releasing a tubular and comprising an elevator (13) having slips (15) for gripping and releasing a tubular (39,40). A spider (12) has slips (14) for gripping and releasing the tubular (33). A mechanically operated valve (18) is provided for controlling the supply of pressurised fluid to move the spider slips (14) between a gripping position and a release position, with sensor means (28) detecting when the elevator slips (15) are in the gripping position. Means (31) mechanically inhibits movement of the valve (18) to a position in which the spider slips (14) release the tubular (40) when said sensor means (28) detects that the elevator slips (15) are not in a correctly gripping position. A second valve (20) controls movement of the elevator slips (15) and a guide plate (24) links control of both valves (18, 20).

34 Claims, 15 Drawing Sheets

COMBINED GRIP CONTROL OF ELEVATOR AND SPIDER SLIPS

The present invention relates to a method and apparatus for gripping tubulars, for example drill pipe. More particularly, the present invention relates to the provision in such a method and apparatus of a mechanism for avoiding the accidental release of tubulars during a handling operation.

During the construction and maintenance of oil wells it is necessary to construct extremely long strings of tubulars. For example, in order to drill a well a drill string is used, whilst after a well has been drilled a casing string must be constructed in order to line the well. Subsequently, a tubing for conveying oil to the surface is inserted inside the casing. Due to the great weight of such tubular strings, possibly several hundred tons, extreme care is required when constructing, raising, and lowering the strings.

FIG. 1 illustrates in schematic form a typical tubular handling system which is mounted on the surface of an oil drilling platform 1. Mounted in the platform itself is a spider 2 for gripping a tubular 3 extending beneath the platform 1 into a well. The spider 2 may be mounted within a rotary table, for example where the string 3 is a drill string. Suspended above the platform 1 is an elevator 4 which is arranged to grasp individual lengths of tubular 5 which are to be attached to the string 3, or alternatively which have just been removed from the string 3. The elevator 5 must also take the full weight of the string 3 during the raising or lowering of the string 3 through the spider 2 (and immediately following the addition or removal of a length of tubular from the string). Both the spider 2 and the elevator 5 must be able to take the full weight of the string 3.

A typical sequence of events during the making up of a string is as follows:

- the spider grips the existing string;
- a new length of tubular is removed from a storage rack and is gripped in a vertical orientation by the elevator;
- the elevator is moved to position the lower pin 7 of the new length above the upper box 6 of the string projecting from the spider—and the opposed pin and box are engaged;
- the grip of the elevator is released, and the new length is engaged by a power tong and spinner and the joint tightened;
- the elevator again grips the string and is raised slightly to take the weight of the string, and the spider releases the string;
- the string is lowered by the elevator through the spider by the height of one length of tubular;
- the string is once again gripped by the spider, and the elevator released to collect a further length of tubular.

The basic construction of the spider 2 and the elevator 5 is the same and is illustrated in a cross-section in FIG. 2. A hollow cylindrical structure 8 has an inner wall which slopes outwardly towards its upper opening. A member 9 supports a set of slips (for example three) 10 which are shaped to slide into the upper opening of the structure 8 and at to engage the sloping inner sidewalls of the structure 8. The slips 10 are free to move radially to a limited extend. Each slip 10 can be raised and lowered relative to the structure 8 by a pneumatically or hydraulically driven piston 11 which engages a cylinder extending into the structure 8. It will be understood that when the slips 10 are in the lowered position, they will engage the outer surface of a tubular passing through the centre of the apparatus. The weight of the tubular and the friction between the tubular and the slips 10 will force the slips 10 downward and inward (as a result of the reaction force between the slips 10 and the inner surface of the structure 8). Thus the grip tightens on the tubular 5.

The hydraulic or pneumatic power which can be applied to the pistons which move the slips is limited. The resulting force is not sufficient to raise the slips of an elevator or spider when that elevator or spider is taking the weight of any significant length of tubular. In theory at least it is not possible for an operator to release the slips of the elevator and the spider at the same time, an action which would result in the dropping of the tubular into the well.

A potential problem with the slip design described however is that it is possible, when the new length of casing has been attached to the string and the elevator regrips the tubular, for the elevator to grip the tubular at too high a point such that the slips contact the tubular at the junction between the outstanding box and the main body of the tubular. Thus, the only contact between the slips and the tubular may be over a small part of the length of the slips. This situation is illustrated in FIG. 3. The elevator may be able temporarily to hold a sufficient proportion of the full tubing string weight to allow the spider slips to be released. However, following the raising of the spider slips, the elevator may not be able to take the full weight of the string with the string being dropped into the well.

A possible solution to the problem has been disclosed in U.S. Pat. No. 4,676,312. This document describes an interlock circuit in which the supply of pressurised air to the valve which controls the movement of the spider slips is prevented by an interlock valve if the elevator slips are not correctly engaged with the tubing.

According to a first aspect of the present invention there is provided apparatus for gripping and releasing a tubular, the apparatus comprising:

- an elevator having slips for gripping and releasing the tubular;
- a spider having slips for gripping and releasing the tubular;
- a valve for directly controlling a supply of pressurised fluid to move the spider slips between a gripping position and a release position; and
- means for mechanically inhibiting movement of said valve to a position in which the spider slips release the tubular when the elevator slips are not in a gripping position.

As used here, the term "elevator" means apparatus which is arranged to grip and hold a tubular for the purpose of raising and lowering the tubular. The term "spider" means an apparatus arranged to grip and hold a tubular whilst remaining substantially stationary.

Embodiments of the present invention may significantly reduce the risk of a tubular being dropped into the well as a result of the elevator slips not properly engaging the uppermost length of a tubing string. The movement of the valve controlling the opening of the spider slips is mechanically inhibited if the elevator slips are not correctly engaging the tubular.

Preferably, said valve for directly controlling the supply of pressurised fluid to move the spider slips is a mechanically operated valve which is operated manually. Alternatively however, the valve may be operated by an electrical motor, solenoid, etc, and/or may be remote controlled (e.g. using radio, infra-red, or ultrasonic signals).

In certain embodiments of the present invention, the valve for controlling the supply of pressurised fluid to the spider slips is operated by a lever. The means for mechanically inhibiting movement of the valve comprises a guide plate through which the lever projects. The guide plate is moveable between first and second positions. In a first position the guide plate prevents movement of the lever to open the valve and in a second position allows movement of the lever to open the valve. Movement of the guide from the first position to the second position is prevented if the elevator slips are not correctly closed.

In certain embodiments of the present invention, the apparatus comprises sensor means for detecting when the elevator slips are in the correct gripping position. The sensor means is coupled to said means for mechanically inhibiting movement of the spider control valve.

In certain embodiments of the invention, the sensor means comprises a piston and cylinder arrangement coupled between the main body and the slips of the elevator. The piston and cylinder arrangement is coupled hydraulically to said means for mechanically inhibiting movement of the spider control valve.

In other embodiments of the present invention, said sensor means comprises a switch which is moved from a first position to a second position when the elevator slips are moved to the correct closed position. When the switch is in the first position, movement of the guide plate from its first to its second position is prevented. When the switch is in the second position, movement of the guide plate from its first to its second position is possible. More preferably, the switch controls the supply of pressurised fluid to a piston and cylinder arrangement, the piston of which locks the guide plate in its first position when the supply of pressurised fluid to the cylinder is prevented, and releases the guide plate when the supply of pressurised fluid to the cylinder is allowed. Preferably, said switch is arranged to directly open and close a hydraulic or pneumatic circuit. Alternatively, the switch may form part of an electrical circuit which is arranged to open and close a hydraulic or pneumatic circuit.

The means for mechanically inhibiting movement of the spider control valve may comprise a piston and cylinder arrangement of a hydraulic or pneumatic circuit coupling an elevator control valve to a piston and cylinder arrangement for opening and closing the elevator slips. The first mentioned piston and cylinder arrangement is located between the piston and cylinder arrangement for moving the slips and the elevator control valve. A rod of the first mentioned piston and cylinder arrangement is displaced by the flow of fluid in the circuit to inhibit or allow movement of the spider control valve.

Other arrangements for locking and unlocking the guide plate are envisaged. The sensor may be an optical or electrical switch which detects closure of the elevator slips. The switch may control the supply of pressurised fluid (pneumatic or hydraulic) to a guide plate locking means.

The apparatus may comprise a mechanical link coupling the elevator slips to the means for mechanically inhibiting movement of the spider control valve. For example, the link may be a Bowden cable where movement of the elevator slips causes a corresponding movement of the core of the cable which is connected to the means for inhibiting movement of the spider control valve.

It will be appreciated that the apparatus may also comprise a mechanically operated valve for controlling the supply of pressurised fluid to move the elevator slips between a gripping position and a release position. This valve may be operated by a lever which also projects through said guide plate. Preferably, when the guide plate is in its first position, the lever may be moved to open the elevator slips, whilst when the guide plate is in its second position, movement of the lever to open the slips is prevented.

In alternative embodiments of the invention, the mechanically operated valve for controlling the supply of pressurised fluid to move the spider slips between a gripping position and a release position may be operated by a switch, knob, or the like, with movement of the knob, switch, etc being inhibited to prevent the valve being operated to open the spider slips when the elevator slips are not correctly closed.

An additional user operable locking means may be provided for preventing accidental movement of the guide plate between the first and second positions.

In alternative embodiments of the invention, the apparatus comprises a second valve for directly controlling a supply of pressurised fluid to move the elevator slips between a gripping position and a release position, wherein said means for mechanically inhibiting movement of the first mentioned valve comprises a mechanism for meshing said first and second valves together.

Preferably, the first and second valves are capable of controlling the flow of pressurised air and hydraulic fluid. More preferably, the first and second valves are ball valves.

Preferably, the first and second valves may each be rotated between a first position in which the associated set of slips is caused to be closed and a second position in which the associated set of slips is caused to be open. More preferably, the meshing of the valves results in the locking of the first valve in the first position, when the second valve is in the second position, and the release of the first valve when the second valve is rotated from the second to the first position. The meshing of the valves may also result in the locking of the second valve in the first position, when the first valve is in the second position, and the release of the second valve when the first valve is rotated from the second to the first position.

The first and second valves may each comprise a substantially cylindrical body member rotatable around its longitudinal axis. Each cylindrical body has an arcuate section cut away, and the cylindrical bodies are arranged co-axially so that when the first valve is located in the first position, and the second valve is located in the second position, part of the second valve is located in the cut away of the valve, and vice versa when the first valve is located in the second position and the second valve is located in the first position.

Preferably, the means for mechanically inhibiting movement of the spider slips control valve further comprises sensor means for detecting when the elevator slips are in the correct gripping position. The sensor means is coupled to a mechanism for locking said first valve in the first position when the elevator slips are detected to be open, thus preventing rotation of the first valve from the first to the second position, and the release of the second valve.

Preferably, second sensor means is provided for detecting when the spider slips are in the correct gripping position. The second sensor means is coupled to a mechanism for mechanically locking the second valve in the first position when the spider slips are detected to be open, thus preventing rotation of the second valve from the first to the second position, and the release of the first valve.

The first and second detector means and the respective valve locking mechanisms ensure that a valve cannot be moved from the first to the second position to open the associated slips, unless the other set of slips are detected to be closed.

In certain embodiments of the invention, the first and second sensor means comprise respective piston and cylinder arrangements arranged beneath the slips of the elevator and spider. Each piston and cylinder arrangement is coupled hydraulically or pneumatically to the corresponding locking mechanism. Each locking mechanism may comprise a hydraulically or pneumatically operate locking rod which is moveable between a position in which the rod engages the corresponding valve and a position in which the rod is disengaged from that valve.

The apparatus may comprise a mechanical link coupling the elevator slips to the means for mechanically inhibiting movement of the spider control valve. For example, the link may be a Bowden cable where movement of the elevator slips causes a corresponding movement of the core of the cable which is connected to the means for mechanically inhibiting movement of the first valve.

Preferably, said valves for directly controlling the supply of pressurised fluid to move the spider and spider slips are mechanically operated valves which are operated manually. Alternatively however, the valves may be operated by electrical motors, solenoids, etc, and/or may be remote controlled (e.g. using radio, infra-red, or ultrasonic signals).

In one embodiment of the invention, said means for mechanically inhibiting movement of said valve comprises a sensor coupled to the elevator slips and arranged to sense movement of the elevator slips between an open and a closed position, the sensor being coupled to an electronic controller arranged to control a means for mechanically inhibiting movement of said valve.

According to a second aspect of the present invention there is provided a method of controlling the gripping and releasing of a tubular and comprising mechanically inhibiting movement of control means for directly controlling a flow of fluid to raise and lower a set of spider slips, when a set of slips of an elevator are not correctly gripping the tubular, such that the spider slips cannot be moved from a gripping to a release position.

Preferably said control means is a valve. However, the control means may be any other suitable apparatus such as a pump.

According to a third aspect of the present invention there is provided a method of gripping and releasing a tubular, the method comprising the steps of:

gripping the tubular with a spider;

actuating a set of slips of an elevator in order to move the slips from a position in which the tubular is not gripped by the elevator slips to a position in which the tubular is gripped by the elevator slips;

in the event that actuation of the elevator slips does not cause the slips to move into the gripping position, mechanically inhibiting movement of a valve directly controlling the movement of a set of spider slips such that the spider slips cannot be moved from a gripping to a release position; and in the event that the elevator slips achieve the correct gripping position, allowing said valve to be operated to move the spider slips from the gripping to the release position.

According to another aspect of the present invention there is provided apparatus for gripping and releasing a tubular, the apparatus comprising:

an elevator having slips for gripping and releasing the tubular;

a spider having slips for gripping and releasing the tubular;

a first valve for directly controlling a supply of pressurised fluid to move the spider slips between a gripping position and a release position;

a second valve for directly controlling a supply of pressurised fluid to move the elevator slips between a gripping position and a release position, and said first and second valves being meshed together in order to mechanically inhibit movement of said first valve to a position in which the spider slips release the tubular when the elevator slips are not in a gripping position.

According to another aspect of the present invention there is provided apparatus for gripping and releasing a tubular, the apparatus comprising:

an elevator having slips for gripping and releasing the tubular;

a spider having slips for gripping and releasing the tubular;

a first valve for directly controlling a supply of pressurised fluid to move the spider slips between a gripping position and a release position;

a second valve for directly controlling a supply of pressurised fluid to move the elevator slips between a gripping position and a release position;

sensor means coupled to the elevator and the spider for detecting opening and closure of the respective slip sets; and means coupled to the sensor means and arranged to lock or release the first and second valves in dependence of the outputs of the sensor means.

According to another aspect of the invention there is provided apparatus for gripping and releasing a tubular, the apparatus comprising:

an elevator having slips for gripping and releasing the tubular;

a spider having slips for gripping and releasing the tubular;

a first valve for directly controlling a supply of pressurised fluid to move the spider slips between a gripping position and a release position;

a second valve for directly controlling a supply of pressurised fluid to move the elevator slips between a gripping position and a release position; and sensor means coupled to the elevator and the spider for detecting movement of the elevator and/or spider slips when taking over the load of a tubular.

For a better understanding of the present invention and in order to show how the same may be carried into effect reference will now be made by way of example to the accompanying drawings, in which.

Figure 1:
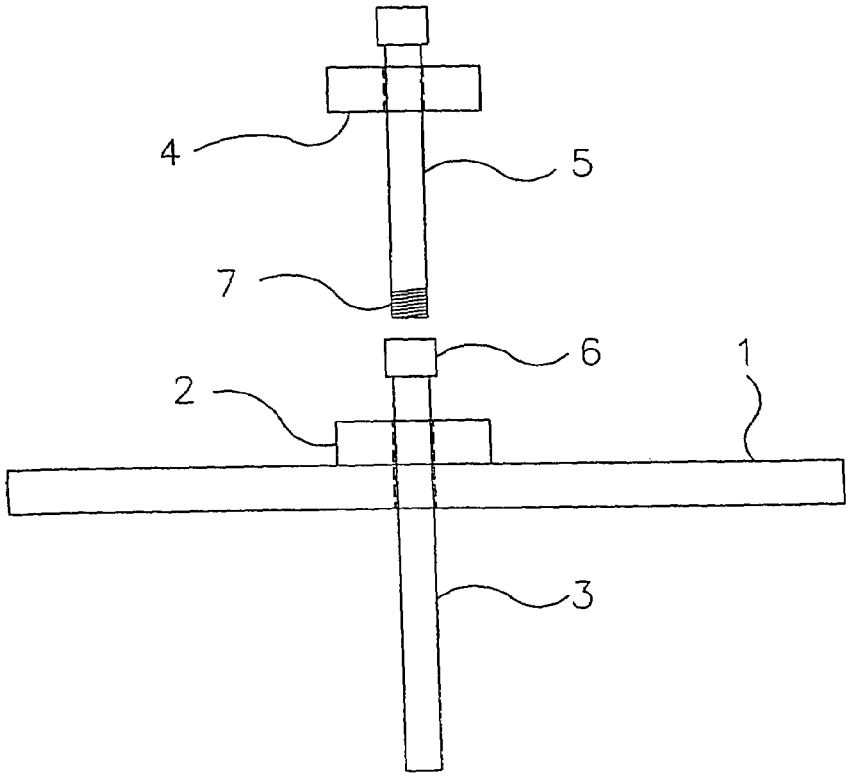
FIG. 1 illustrates schematically an elevator and spider arrangement for handling tubulars.
Figure 12G:
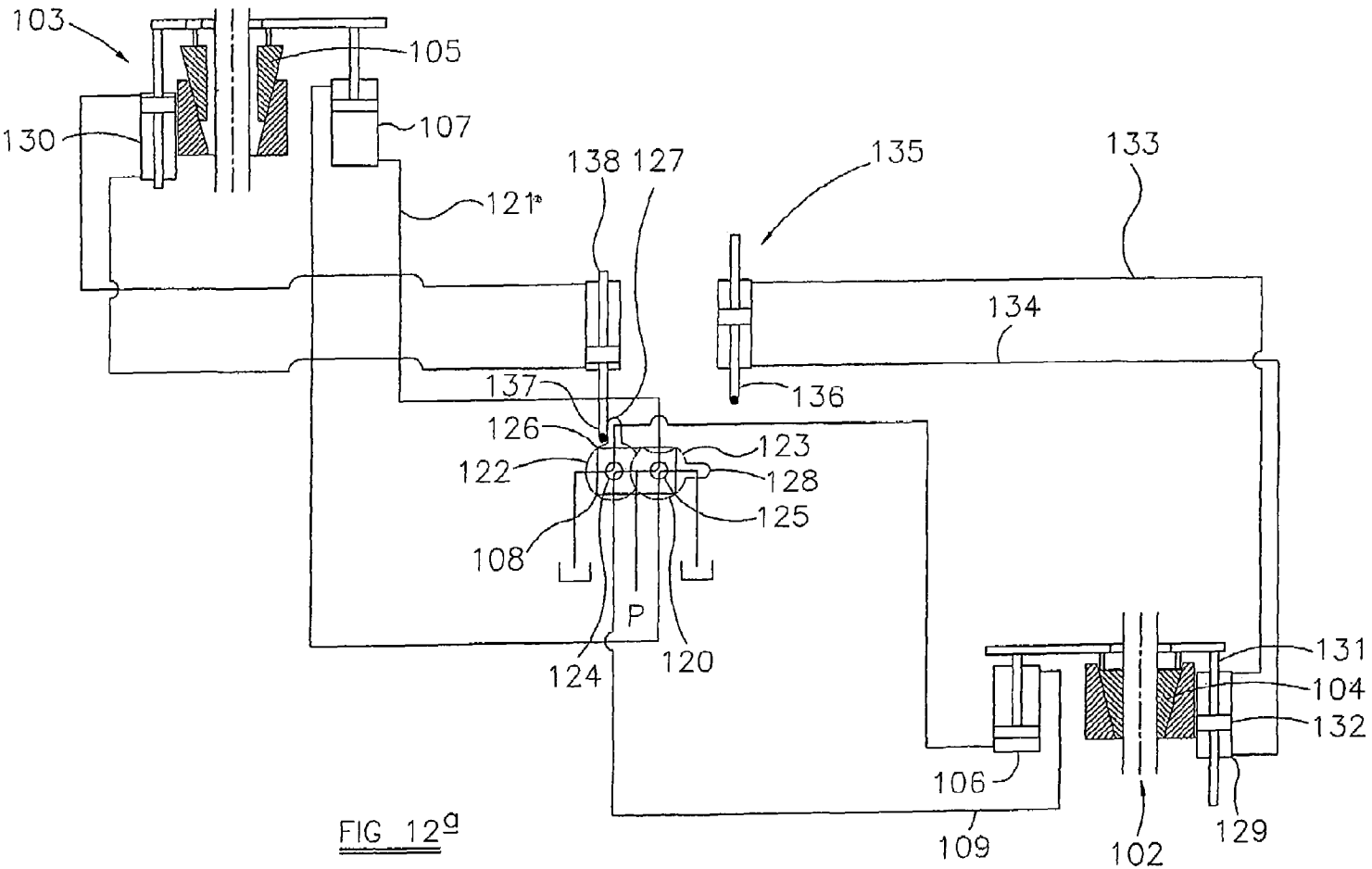
Figure 12B:
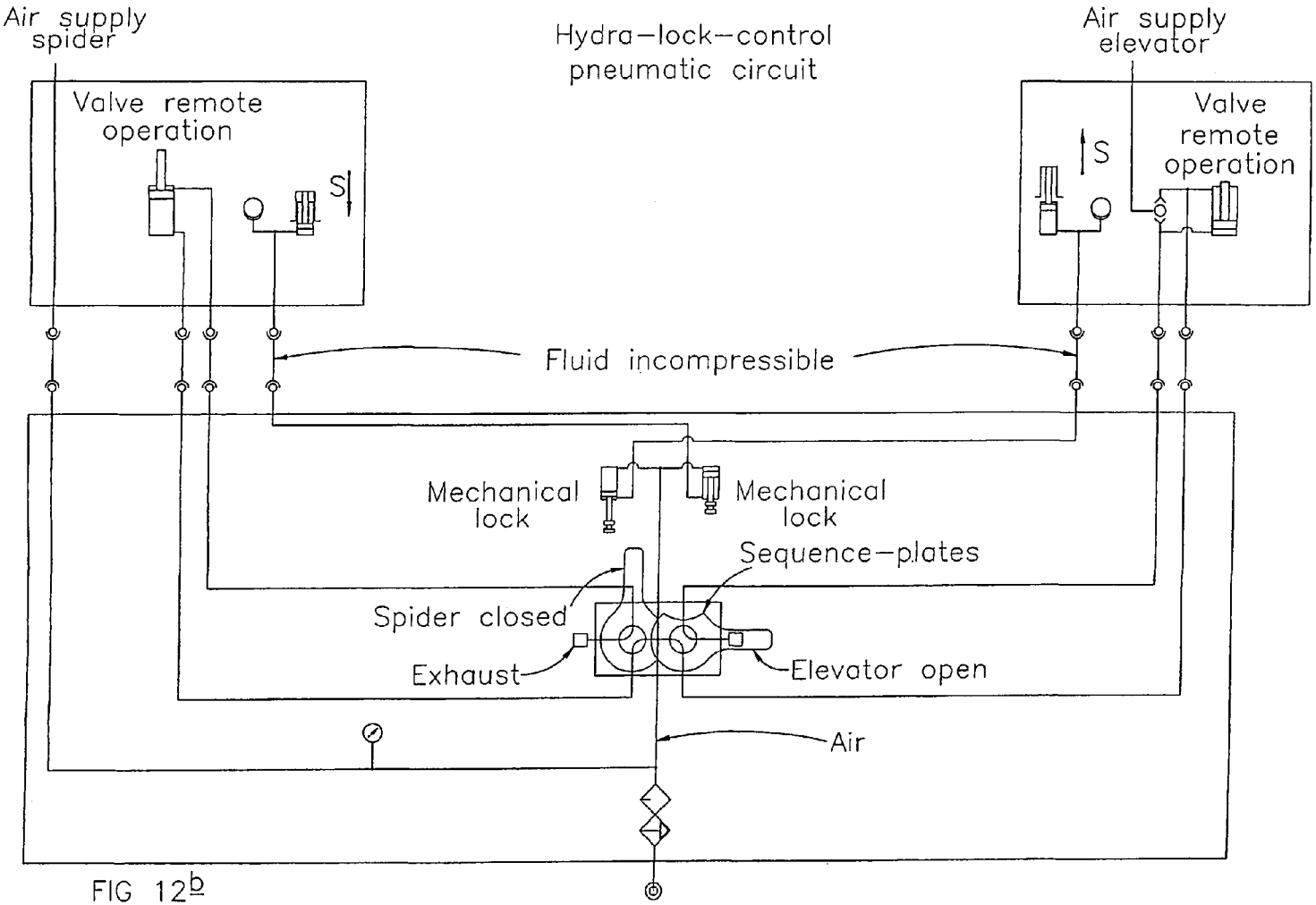
Figure 12C:
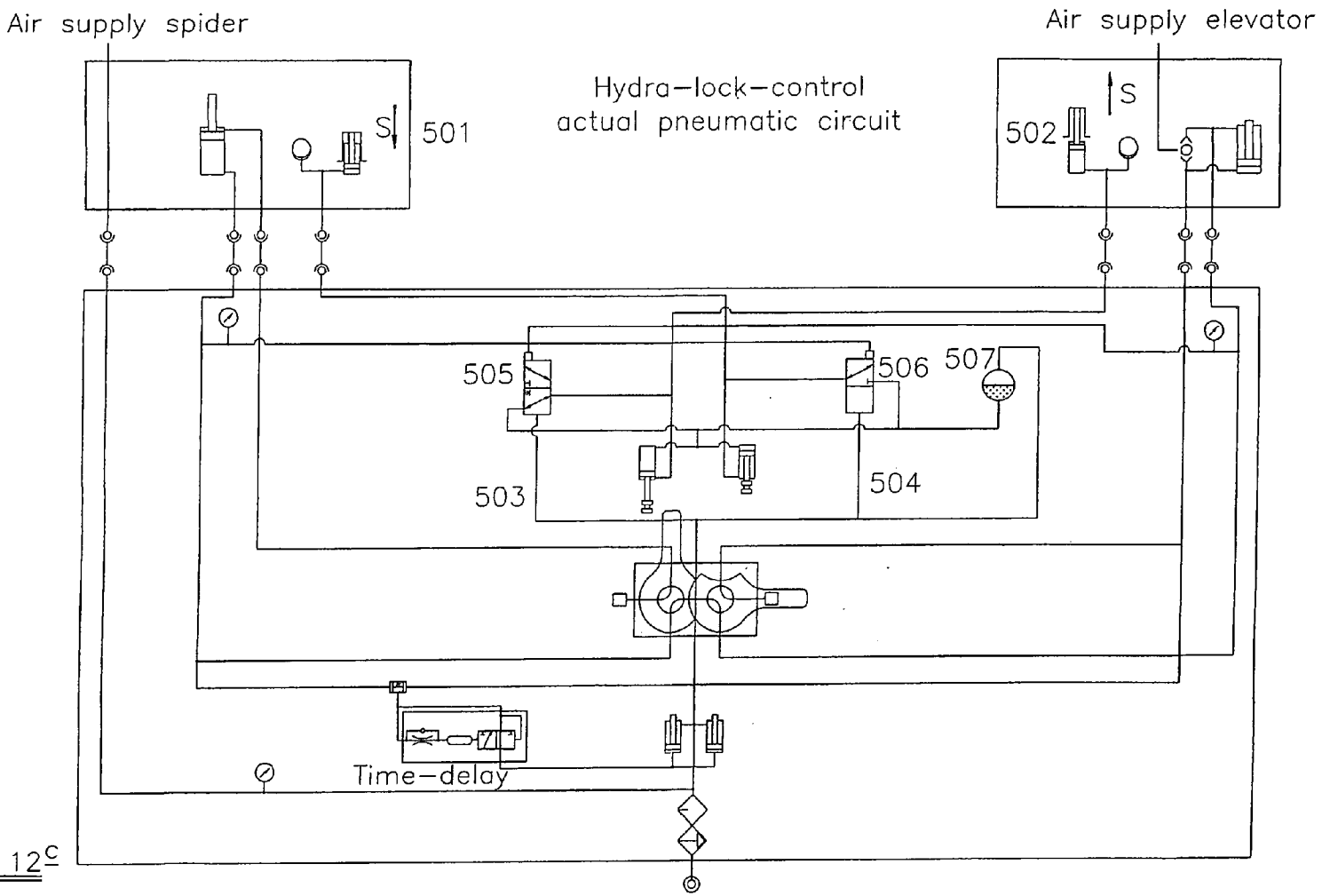
Figure 13:
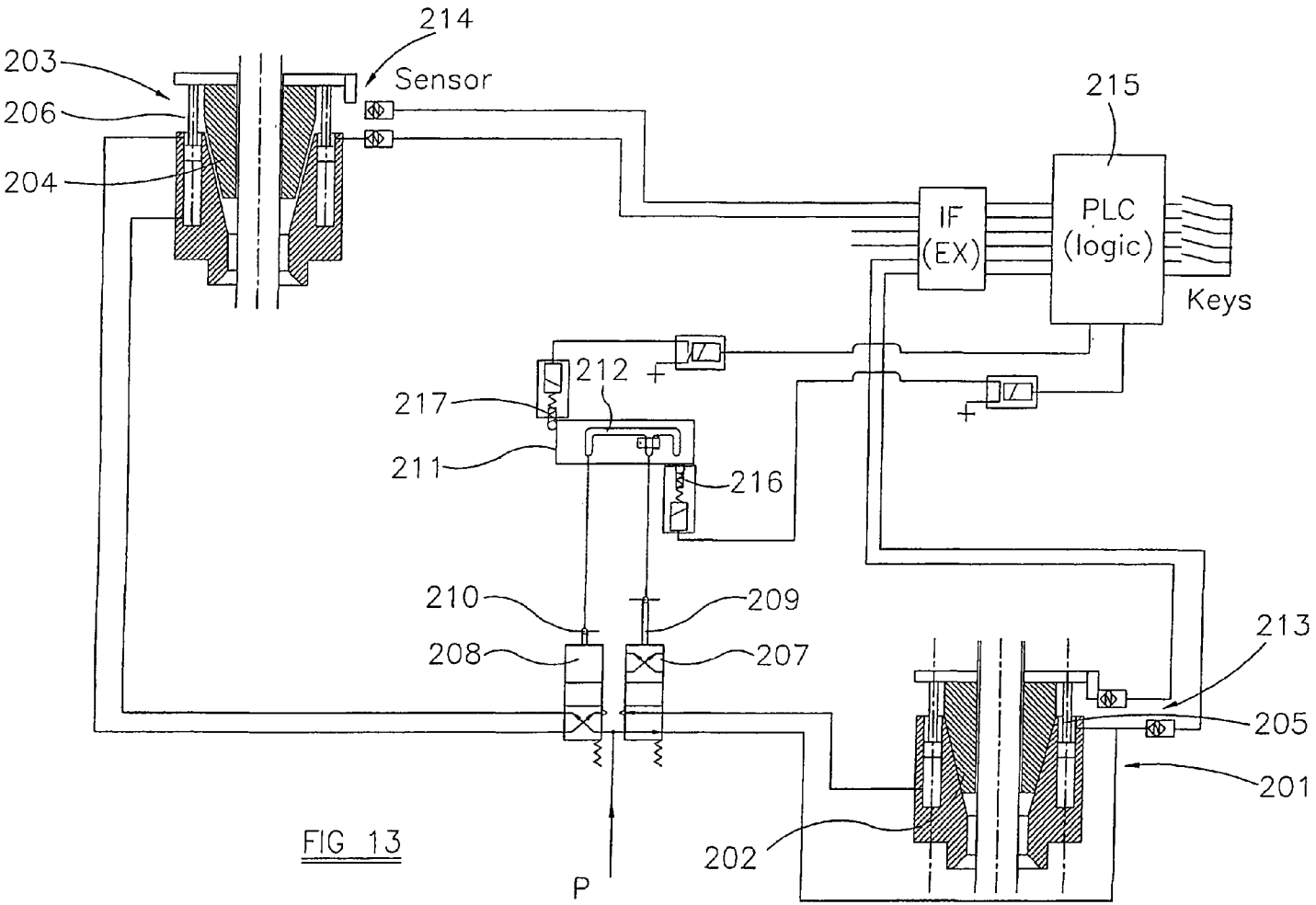
Figure 14:
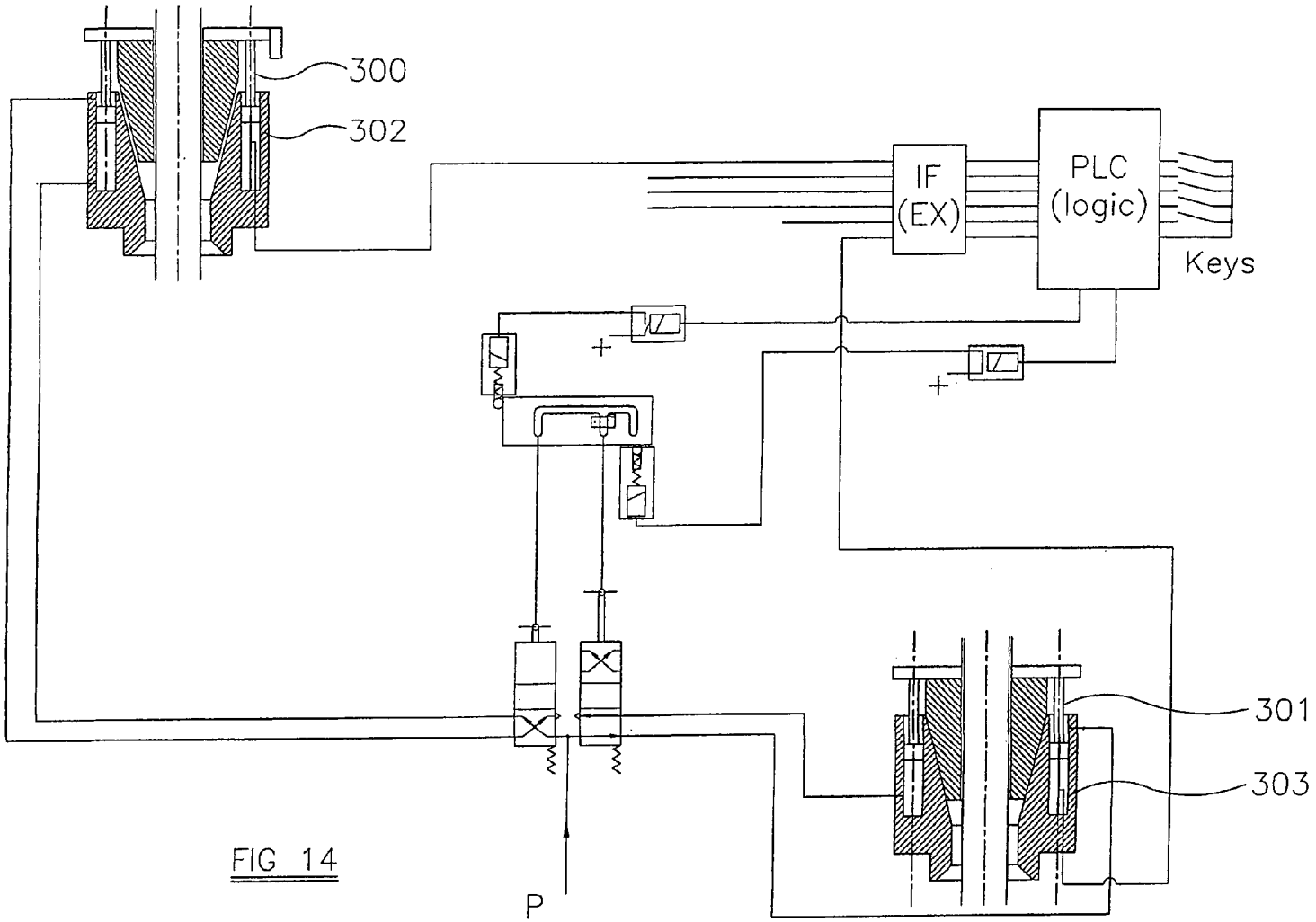

FIG. 12*a* illustrates schematically a hydraulic system for controlling the elevator and spider of the arrangement of FIG. 1;

FIG. 12*b* illustrates schematically a hydraulic system for controlling the elevator and spider of the arrangement of FIG. 1;

FIG. 12*c* illustrates schematically a modified hydraulic system for controlling the elevator and spider of the arrangement of FIG. 1;

FIG. 13 illustrates schematically a pneumatic system for controlling the elevator and spider of the arrangement of FIG. 1;

FIG. 14 illustrates schematically a modified pneumatic control system; and

Figure 15:
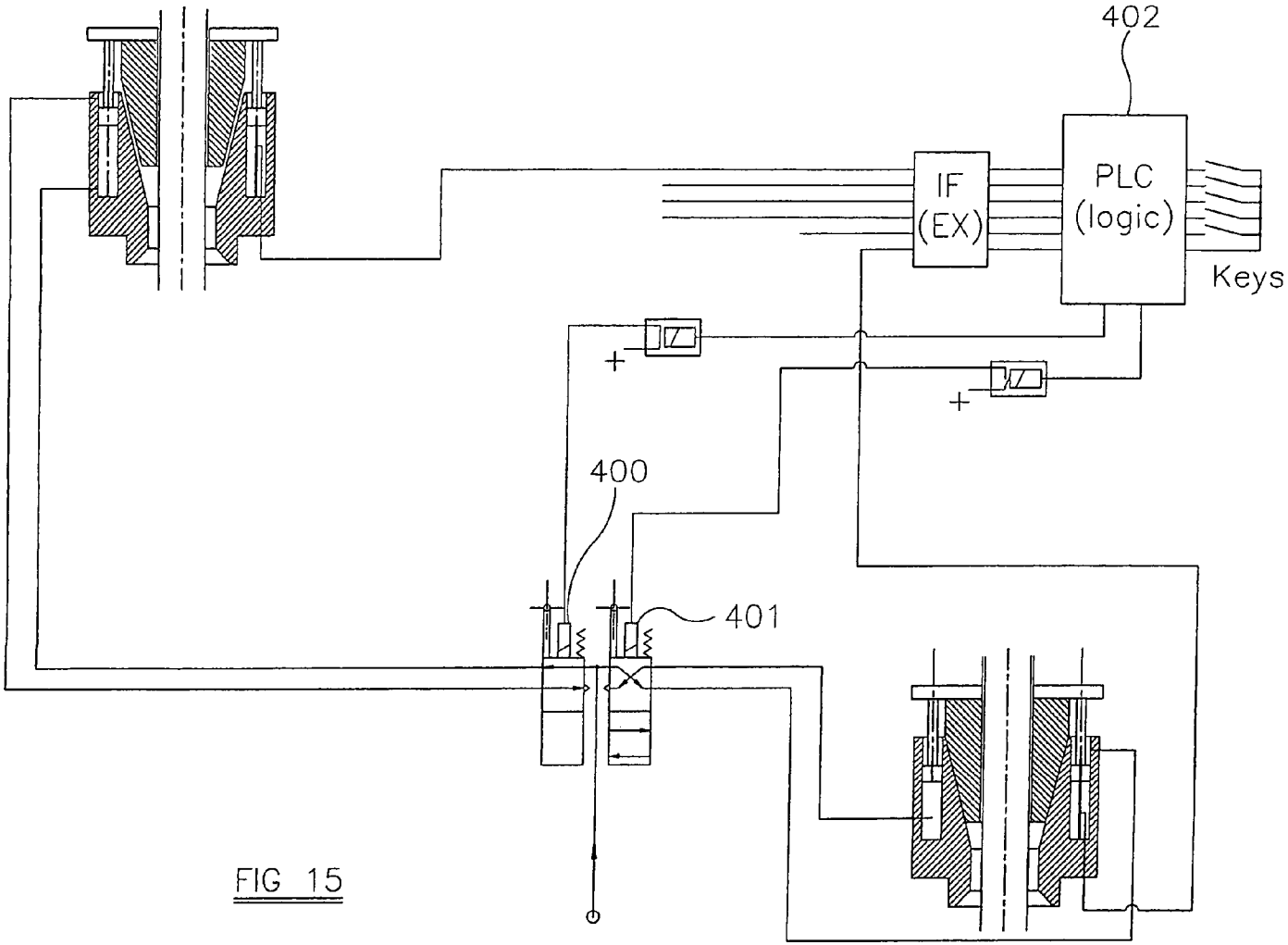

FIG. 15 illustrates schematically a further modified pneumatic control system.

A conventional system for handling tubulars using an elevator and spider arrangement has been described above with reference to FIGS. 1 to 3. There will now be described a control system for controlling the operation of such a spider and elevator arrangement in order to reduce the risk of a tubular being dropped down a well. The following discussion concerns the making or breaking of a drill pipe string although the apparatus and control system can equally be used with a well casing or tubing.

Figure 4:
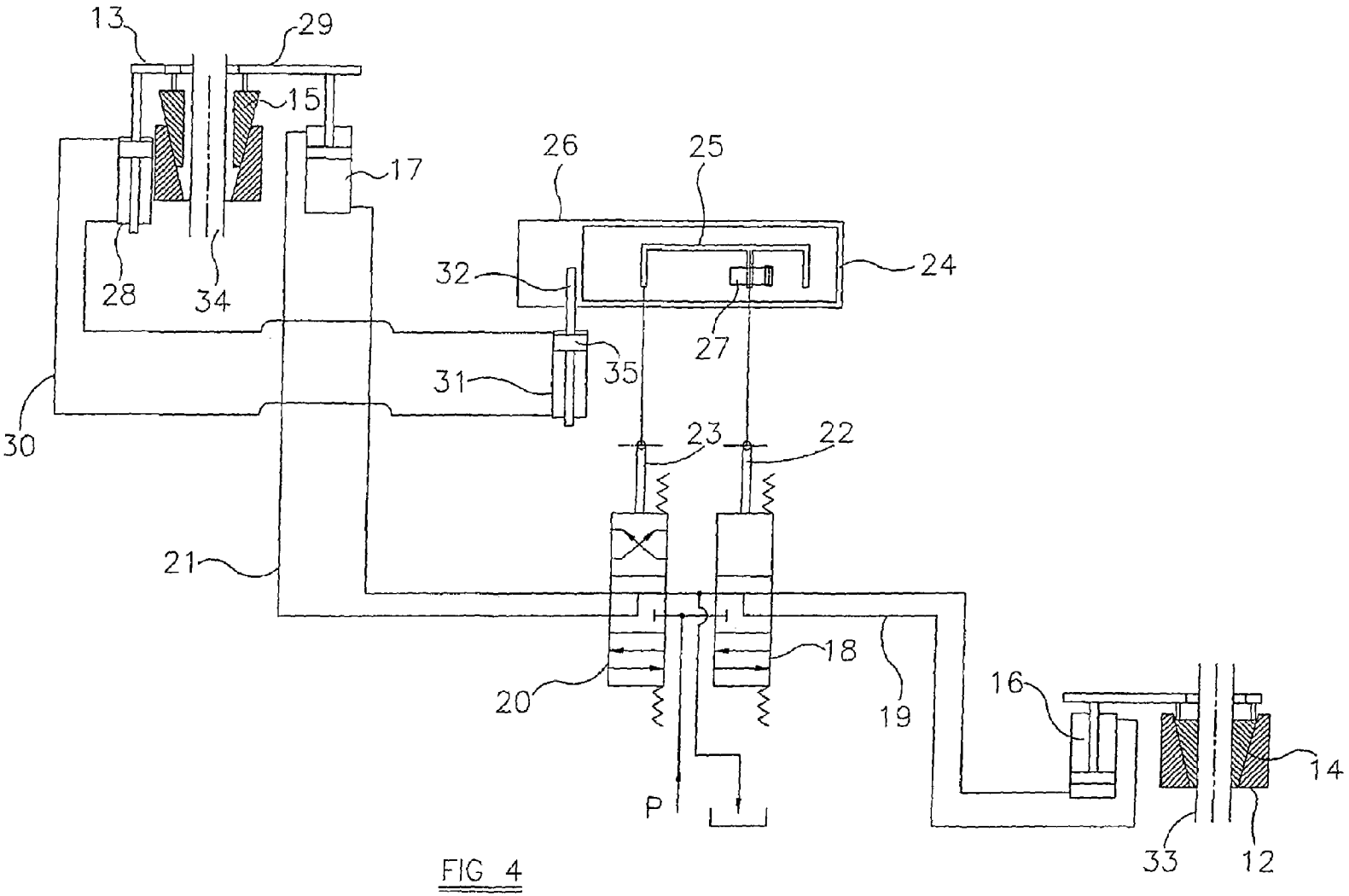
FIG. 4 illustrates schematically a system for controlling the elevator and spider of the arrangement of FIG. 1.

With reference to FIG. 4, there is illustrated a spider 12 having a set of slips 14, and an elevator 13 having a set of slips 15. The spider and elevator each have a construction which is similar to that illustrated in FIG. 2. More particularly, the slips 14, 15 of the spider 12 and elevator 13 are raised and lowered by respective hydraulically operated piston and cylinder arrangements 16, 17 (only one piston cylinder arrangement is shown in FIG. 4 for each of the elevator and spider). Pressurised fluid is supplied to the piston arrangement 16 of the spider 12 via a spider control valve 18 and supply lines 19. Similarly, Pressurised fluid is supplied to the piston and cylinder arrangement 17 of the elevator 13 via an elevator control valve 20 and supply lines 21.

Both the spider control valve 18 and the elevator control valve 20 are operated by respective levers 22,23. In order to close a set of slips 14,15 which are currently in the release position, the lever of the corresponding control valve is moved for a short time (e.g. a few seconds) to a "close" position. After the slips have been moved, the lever is returned to a central "neutral" position. Similarly, in order to open a set of slips 14,15 currently in a closed position, the corresponding lever is moved for a short time to an "open" position before being returned to the central neutral position. Each lever 22, 23 therefore has three positions; open, close, neutral. In the arrangement shown in FIG. 4, the close position for the control valves 18,20 is the uppermost position of the respective levers 22,23, whilst the open position is the lowermost position of the levers. The neutral position lies in the centre.

In order to control the operation of the levers 22, 23, the control valves 18,20 are mounted directly beneath a guide plate 24 (in the schematic illustration of FIG. 4, the control valves 18,20 and levers 22,23 are shown displaced from the guide plate 24 for the sake of clarity). The guide plate 24 has a series of slots 25 machined into it. The slots 25 define the various positions to which a lever 22, 23 can be moved during certain stages of a pipe handling process. The guide plate 24 is slidably mounted within a box 26 which contains the spider and elevator control valves 18, 20. The guide plate 24 can be slid between a first rightmost position to a second leftmost position, providing that both levers 22,23 are in the close positions (and that the guide plate 24 is not otherwise locked—see below).

Figure 5:
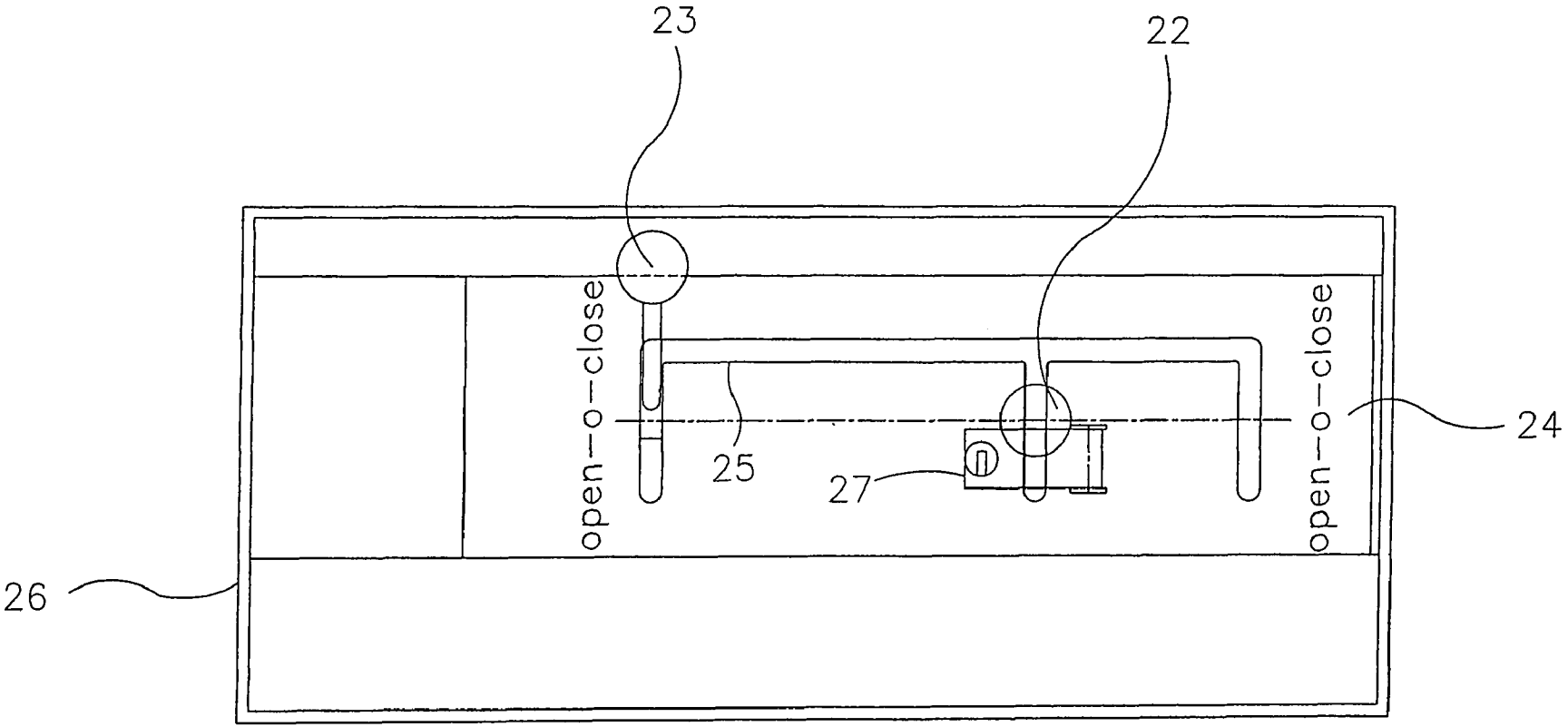
FIG. 5 illustrates in detail a valve control mechanism of the system of FIG. 4.

In the first operational position, the elevator control valve lever 23 can be moved from the neutral position to both the open and close positions, whilst the spider control valve lever 22 may be moved between the neutral and the close position. In the second operational position of the guide plate 24, the elevator control valve lever 23 must remain in the close position, whilst the spider control valve lever 22 may be moved from the neutral position to both the open and close positions. FIG. 5 illustrates the guide plate arrangement in more detail.

With reference again to FIG. 4, an auxiliary hydraulically operated piston and cylinder arrangement 28 is shown coupled to the annular ring 29 on which the elevator slips 15 are mounted. The arrangement 28 does not play an active part in raising and lowering the slips 15, but rather acts as a passive slip position sensor. The position of the piston within the cylinder tracks the position of the elevator slips 15. The arrangement 15 is coupled via hydraulic fluid supply lines 30 to a guide plate locking mechanism 31. This mechanism comprises a further piston and cylinder arrangement. A rod 32 coupled to the piston 35 of the mechanism 31 is arranged to engage the guide plate 24 when the piston 35 is fully extended, locking the guide plate 24 in its rightmost position. However, when the piston 35 is withdrawn, the rod 32 disengages the guide plate 24 allowing the guide plate to move freely between its leftmost and rightmost positions (subject to the position of the levers 22,23).

FIG. 5 illustrates a lock 27 which blocks a slot which, when unblocked, allows the movement of the spider control valve lever 22 to the open position—in exceptional circumstances, when it is required to open the spider slips 14 and the elevator slips 15 at the same time, this lock 27 may be manually removed.

The operation of the control system of FIG. 4 will now be described, assuming that the system has previously been operated such that the slips of the spider 12 are gripping a lower portion of a drill string 33 whilst the slips 15 of the elevator 13 are in the raised or open position relative to an upper length of drill pipe 34. Assume now that the upper length 34 has been attached to the lower drill pipe string 33 and that the joint has been sufficiently tightened. In order to allow the drill string 33 to be lowered through the spider 12 such that a further length of drill pipe may be attached to the top of the string 33, the slips 14 of the elevator 13 must be closed to allow the elevator 13 to take the full weight of the drill string 39 when the spider slips 14 are raised. The guide plate 24 is currently in the rightmost position such that the lever 23 of the elevator control valve 20 can be moved from the neutral position to either the open or close position. The lever 23 is moved by the operator to the close position and the control valve 20 opened to supply pressurised fluid to the top of the piston cylinder arrangement 17. The application of pressurised fluid results in the slips being lowered into the elevator 13.

Figure 6:
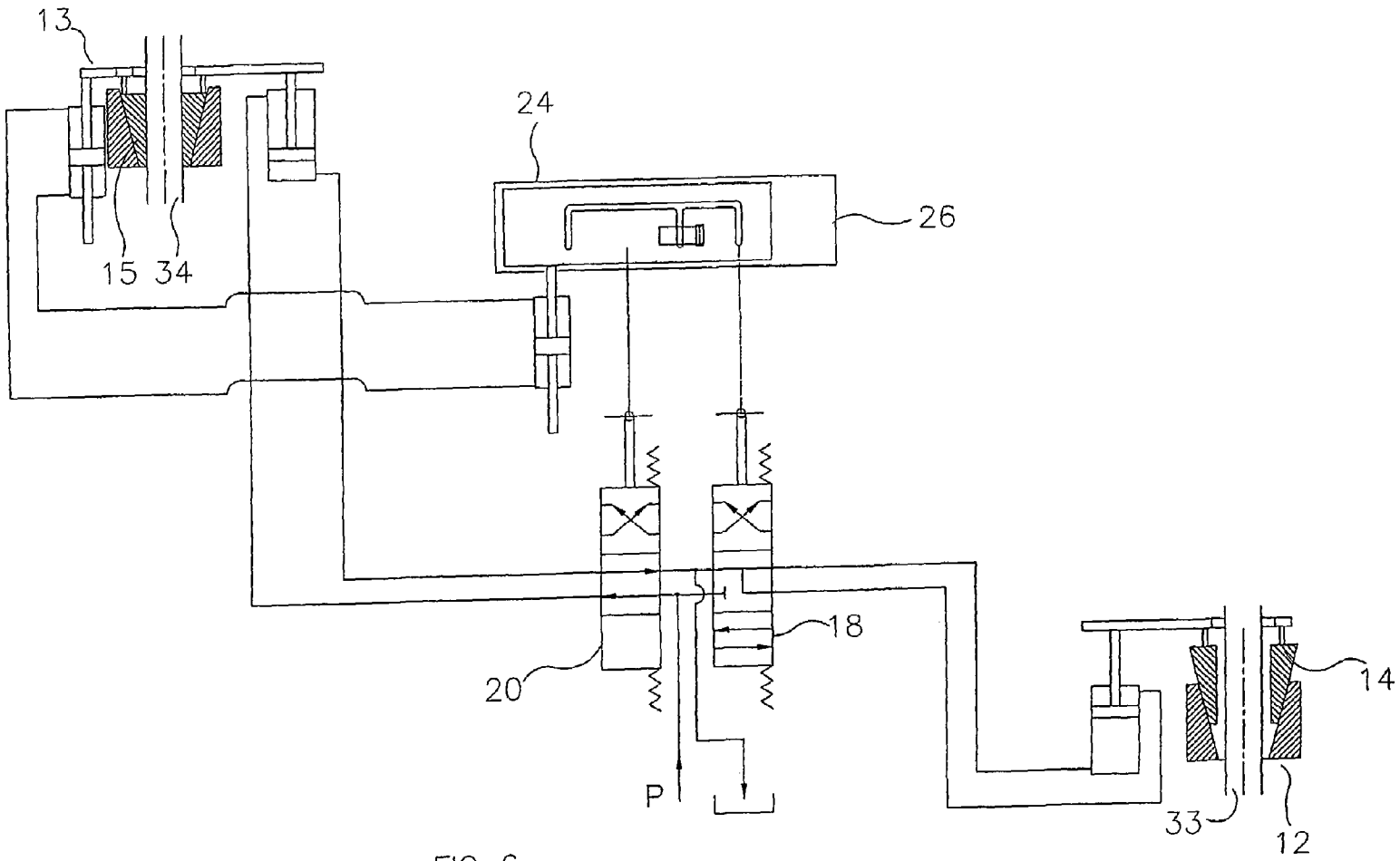
FIG. 6 illustrates the control system of FIG. 4 in a second operational configuration.

The position of the piston within the arrangement 28 tracks the position of the elevator slips 15 relative to the elevator body. Movement of the piston within the cylinder causes fluid to be expelled from the cylinder, through the supply lines 30 into the top of the cylinder of the arrangement 31. This causes the piston 35 to be withdrawn into the cylinder, moving the locking rod 32 away from the guide plate 24. When the elevator slips 15 have been lowered to the correct position in which they engage the body of the pipe length 34, the rod 32 is disengaged from the guide plate 24. In this position, the guide plate 24 can be moved by the operator to the left providing that both levers 22,23 are held in the close position. The lever 22 can then be operated to open the spider slips 14. This configuration is illustrated in FIG. 6.

Figure 3:
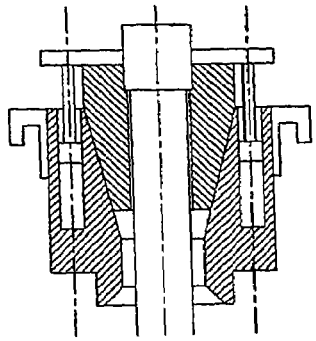
FIG. 3 illustrates a scenario where the elevator slips are not correctly gripping a tubing.

In the event that the operator moves the elevator control valve lever 23 to the close position whilst the elevator 13 is located at too high a position with respect to the upper length of drill pipe length 34, it is possible that the elevator slips 15 may close around the junction between the upper box of the pipe and the main body of the pipe (the situation illustrated in FIG. 3). If this happens, then the grip achieved by the elevator 13 on the pipe length 34 is not necessarily sufficient to take the full weight of the drill pipe string 33. The grip achieved might be sufficient to take enough of the weight to allow the spider slips 14 to be raised. As has already been described, this situation can result in the subsequent dropping of the string into the well. However, it will be appreciated that if the elevator slips 15 close about the box of the pipe length 34, then the slips 15 will not be able to move to their correct lower position relative to the elevator body. Rather, the slips 15 will become "jammed" at some intermediate position.

If this situation arises, the piston of the sensor arrangement 28 will not be sufficiently withdrawn into the cylinder. The volume of fluid transferred to the arrangement 31 will not be sufficient to fully disengage the rod 32 from the guide plate 24. It will not therefore be possible for an operator to move the guide plate 24 to the left, and to open the spider slips 14. This embodiment of the present invention therefore provides a mechanical "sequencer" for the spider and elevator control valves 18,20.

Figure 7:
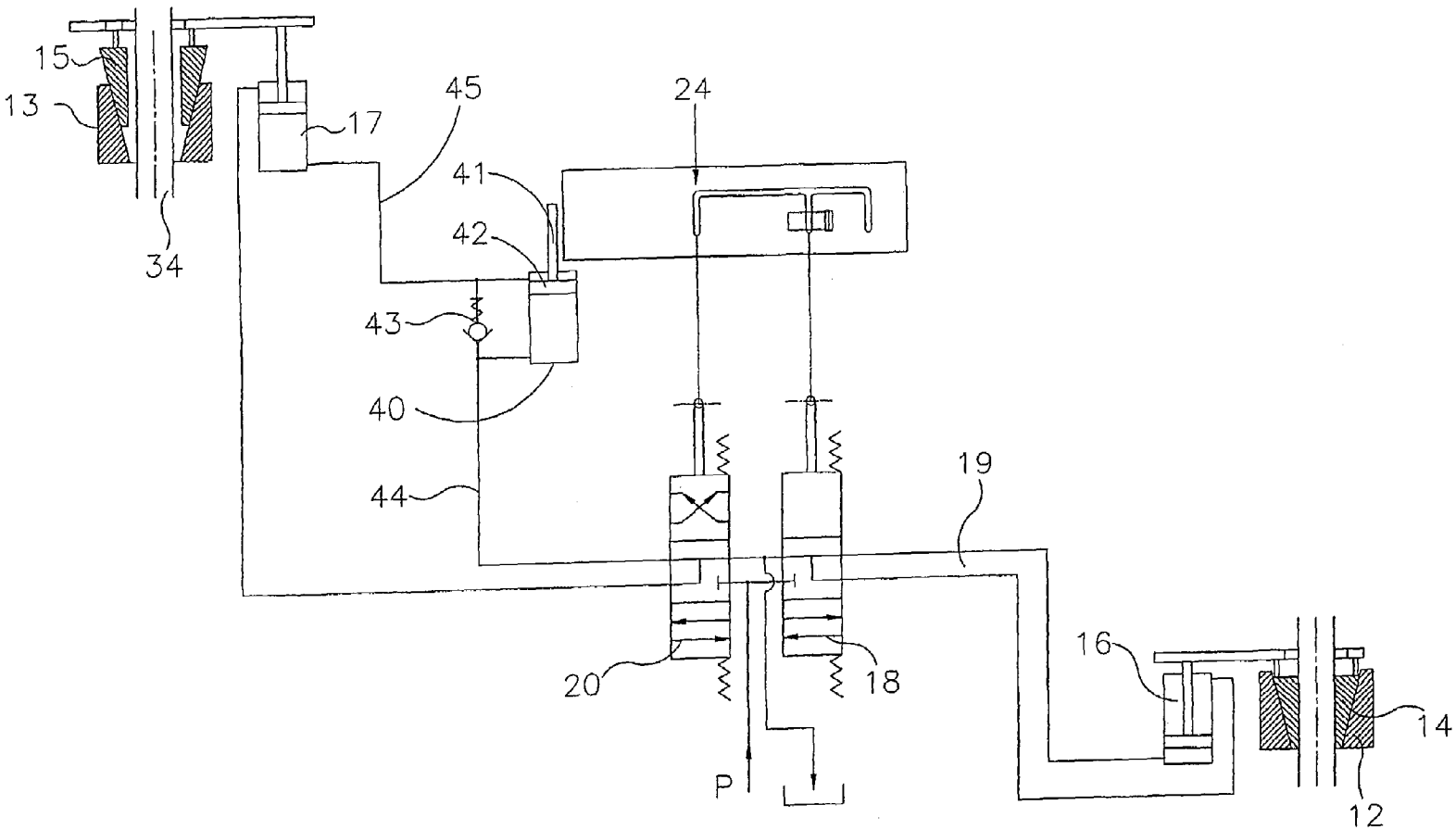
FIG. 7 illustrates schematically a modified system for controlling the elevator and spider of the arrangement of FIG. 1.

FIG. 7 illustrates an alternative control system for ensuring that the spider slips 14 cannot be opened when the elevator slips 15 are not correctly gripping the drill string. Components common to the system of FIG. 4 have been identified using the same reference numerals. A piston and cylinder arrangement 40 has a rod 41 coupled to its piston 42. This rod 41 provides the locking mechanism for the guide plate 24. The arrangement 40 is located within the fluid circuit 44,45 coupling the control valve 20 to the arrangement 17 which raises and lowers the elevator slips 15. A one way valve 43 is connected in parallel with the arrangement 40. When the elevator slips 15 are lowered, fluid is expelled from the cylinder(s) of the arrangement 17. This fluid drives the piston 41 into its cylinder (no fluid can flow through the valve 43), causing the rod 41 to disengage from the guide plate 24. Assuming that the elevator slips 15 are lowered to the correct position, the guide plate 24 is free to move to the left. Of course if the slips are not lowered correctly, then the guide plate 24 is prevented from moving by the rod 41.

When the valve 20 is subsequently operated to raise the elevator slips 15 (following the opening and closing of the spider slips 14), pressurised fluid drives the piston 42 out of its chamber. The pressurised fluid expelled from the chamber is in turn forced into the chamber(s) of the elevator slip drive arrangements 17, causing the elevator slips 15 to be raised. The valve 43 is provided to compensate for leaks, and ensures that sufficient fluid is available to fully open the elevator slips 15 when required.

Figure 8:
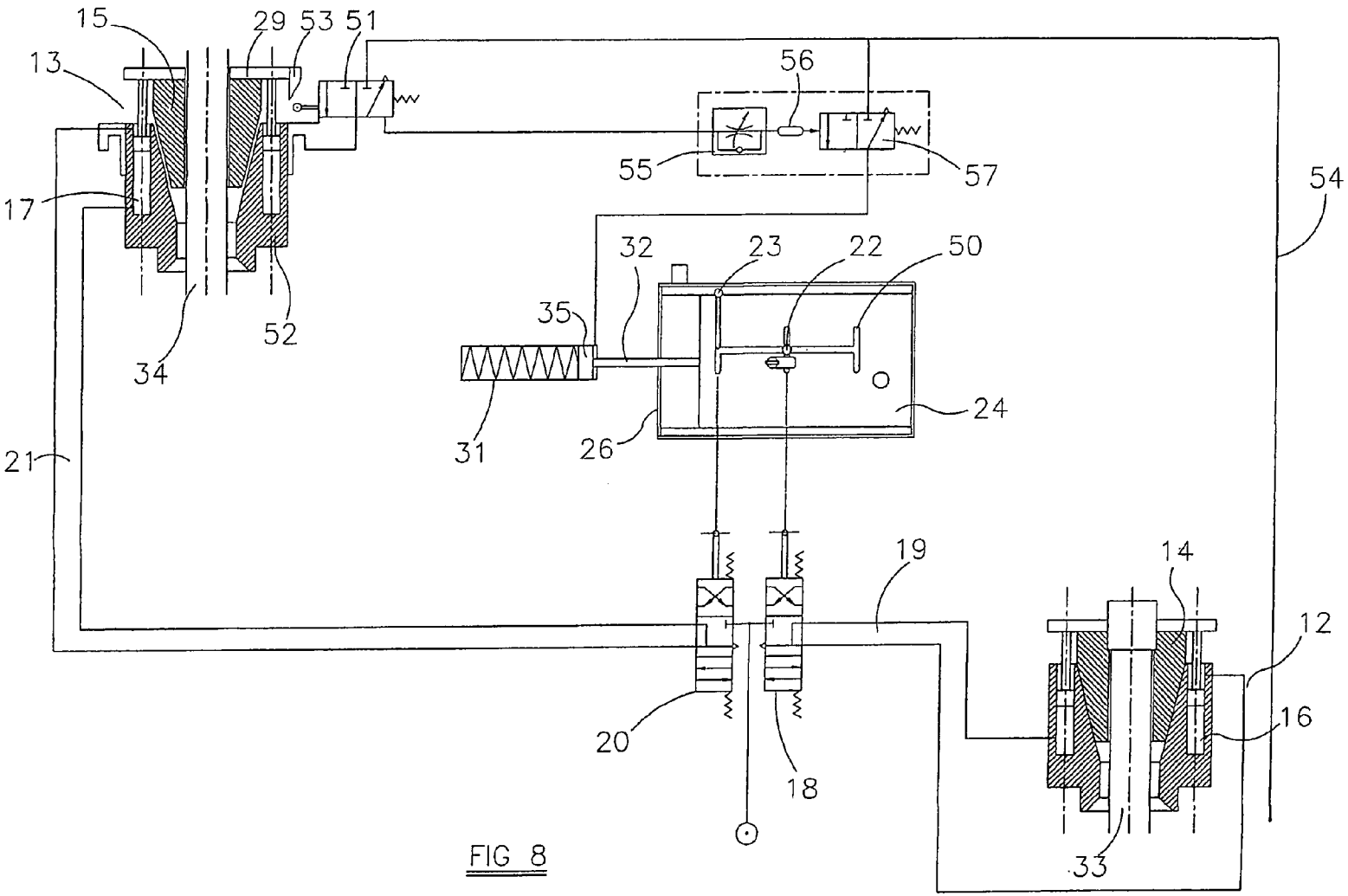
FIG. 8 illustrates an alternative system for controlling the elevator and spider of the arrangement of FIG. 1.

FIG. 8 illustrates another control system according to the present invention. Again, reference numerals used in FIG. 4 have been reused to identify common parts. It is noted that the embodiment of FIG. 8 uses a guide plate 24 having a different arrangement of guide slots 50. This arrangement allows the guide plate 24 to be shifted only when both levers 22,23 are in the neutral position (and movement is not prevented by the locking rod 32). The guide plate 24 is shown in more detail in FIG. 9.

With reference to FIG. 8, a mechanically operated valve switch 51 is rigidly attached to the main body 52 of the elevator 13. The valve switch 51 forms part of a pneumatic control circuit. A contact member 53 is attached to the upper annular ring 29 which supports the slips 15. When the spider slips 15 are in the raised position, i.e. the spider is in the release position, the contact member 53 is not in contact with the valve switch 51. In this position, the valve switch 51 remains closed and does not pass compressed air from its input to an output. However, when the spider slips 15 are in the correct lowered position, and the spider 13 is in the gripping position, the contact member 53 contacts the valve switch 51, causing the switch to open and compressed air to be supplied from the input of the valve switch 51 to its output.

Pressurised fluid is supplied to the input of the valve switch 51 via a supply line 54 (which is coupled to a pressurised source of fluid which is not shown in the drawing). The output of the valve switch 51 is provided to the input of a delay circuit. This circuit comprises a one way flow regulator 55 which allows the compressed air from the output of the valve switch 51 to be fed to the input of an accumulator 56. The output of the accumulator 56 is provided to a control input of a second valve switch 57. The main input of the second valve switch 57 is coupled to the supply line 54. The output of the second valve switch 57 is provided to an input of the piston and cylinder arrangement 31, which input is situated in front of the head of the piston 35.

Figure 10:
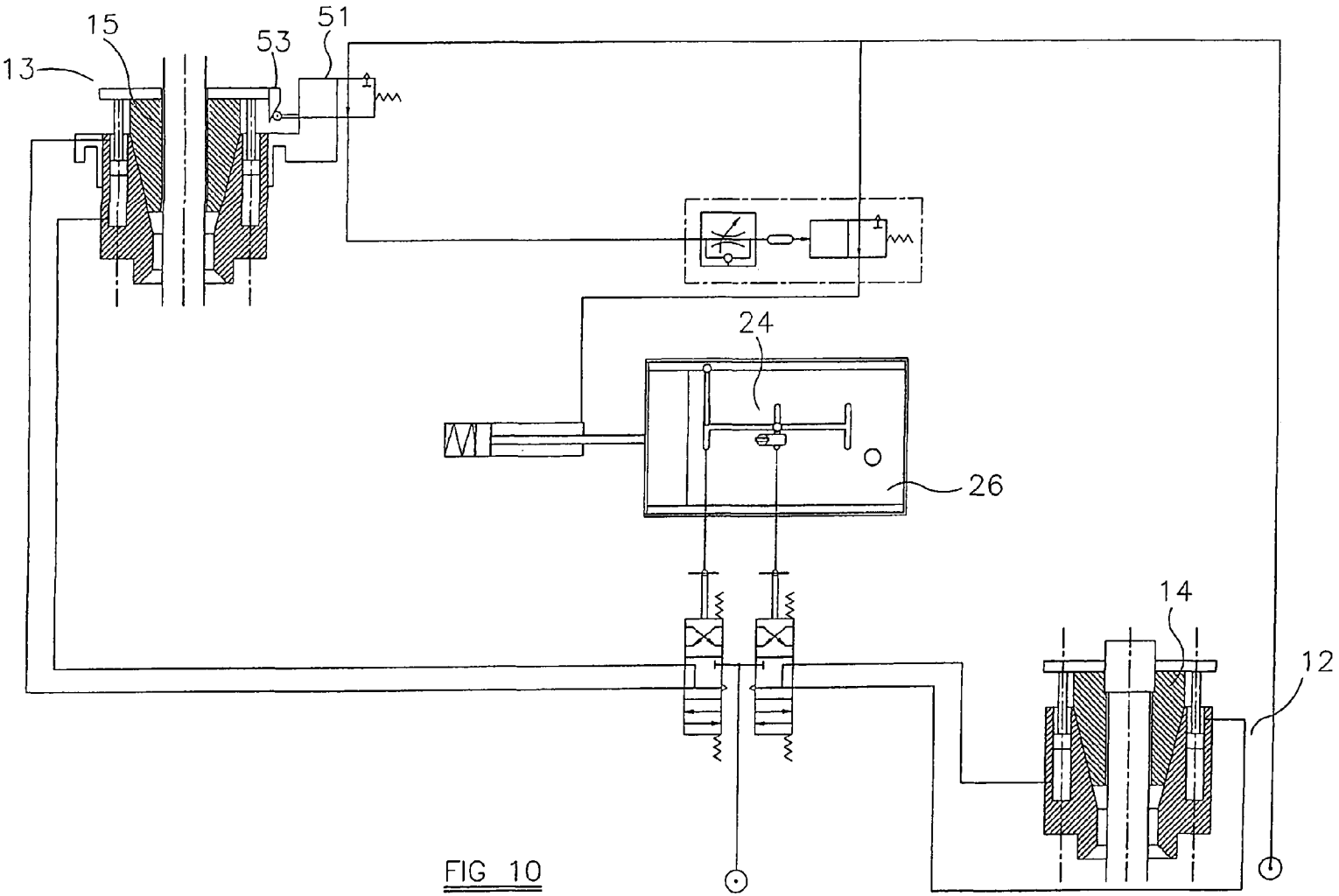
FIG. 10 illustrates the control system of FIG. 8 in a second operational configuration.

In the event that the elevator slips 15 close about the main body of the drill pipe 34, the slips 15 will be lowered relative to the elevator 13 to the required extent. The contact member 53 will contact the valve switch 51, causing the switch to open. Compressed air will flow from the supply line 54, through the flow regulator 55 to the input of the accumulator 56. Pressure builds up in the accumulator 56 until the pressure at the output of the accumulator 56 causes the second valve switch 57 to open. The time taken for the accumulator 56 to charge to a sufficient pressure to activate the second valve switch provides a short time delay between the closure of the elevator slips 15 and the possible release of the guide plate 24. As long as the second valve switch 57 remains closed, no pressure is present at the head of the piston 35 and the piston remains in its fully extended position in which the guide plate 24 is locked in its rightmost position. However, when the second valve switch 57 is opened, compressed air from the supply line 54 is conducted to the head of the piston 35 causing the piston to be retracted within its cylinder. The retraction of the piston 35 causes the guide plate 24 to be released. Assuming therefore that the operation of the lever 23 has resulted in the elevator slips 15 being moved to their correct lowered or closed position, the operator can slide the guide plate 24 to its leftmost position. The operator can then operate the lever 22 of the spider control valve 18 to move the spider slips 14 to their raised or open position. The elevator 13 then takes the full weight of the drill pipe string 33. This configuration is illustrated in FIG. 10.

In the event that the elevator slips 15 grip around the box of the drill pipe 34, the contact member 53 attached to the slip support ring 29 will not contact and open the valve switch 51. Thus, no pressure will be applied to the head of the piston 35 and the guide plate 24 will remain locked in its rightmost position. In this position, the lever 22 operating the spider control valve 18 cannot be moved from its neutral position to open the spider slips.

Figure 9:
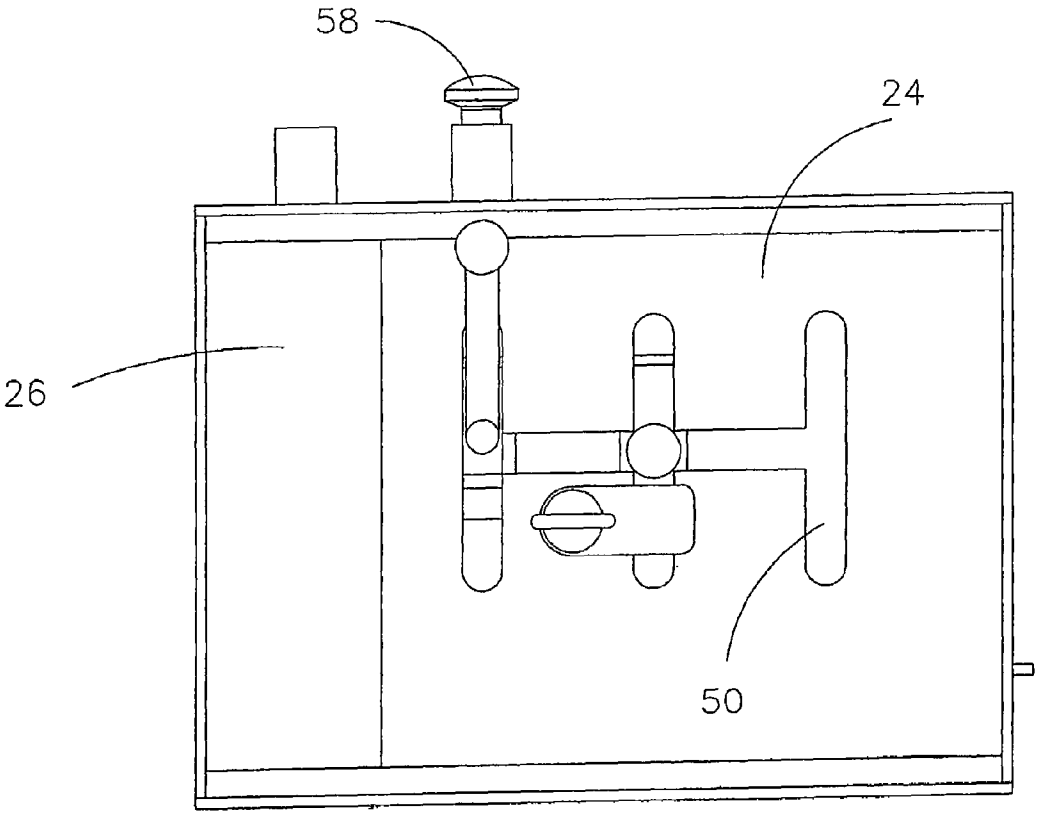
FIG. 9 illustrates in detail a valve control mechanism of the system of FIG. 8.

FIG. 9 illustrates a manually operable locking mechanism 58 which is mounted in the box 26 supporting the guide plate 24. The locking mechanism 58 is of a type which when pulled out allows movement of the guide plate 24 from the left to the right and vice versa whilst when pushed in prevents such movement of the guide plate 24. In order to move the guide plate 24 from the right to the left position, in addition to the piston 35 being fully withdrawn into the cylinder 29, the operator must pull out the locking mechanism 58 (against a spring force) and at the same time slide the guide plate 24 from the right to the left. When the operator releases the mechanism 58, the guide plate cannot be shifted to the right unless the operator again pulls out the mechanism 58. The locking mechanism 58 therefore provides an obstacle to an operator moving the guide plate 24 to the left, opening the spider slips, and then sliding the guide plate to the right and opening the elevator slips (this could of course only happen in the case that a small length of drill pipe is being held by the spider elevator arrangement).

Figure 2:
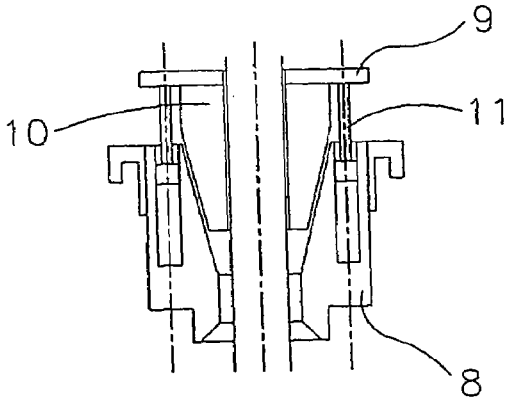
FIG. 2 illustrates in more detail the structure of an elevator/spider of the arrangement of FIG. 1.
Figure 11:
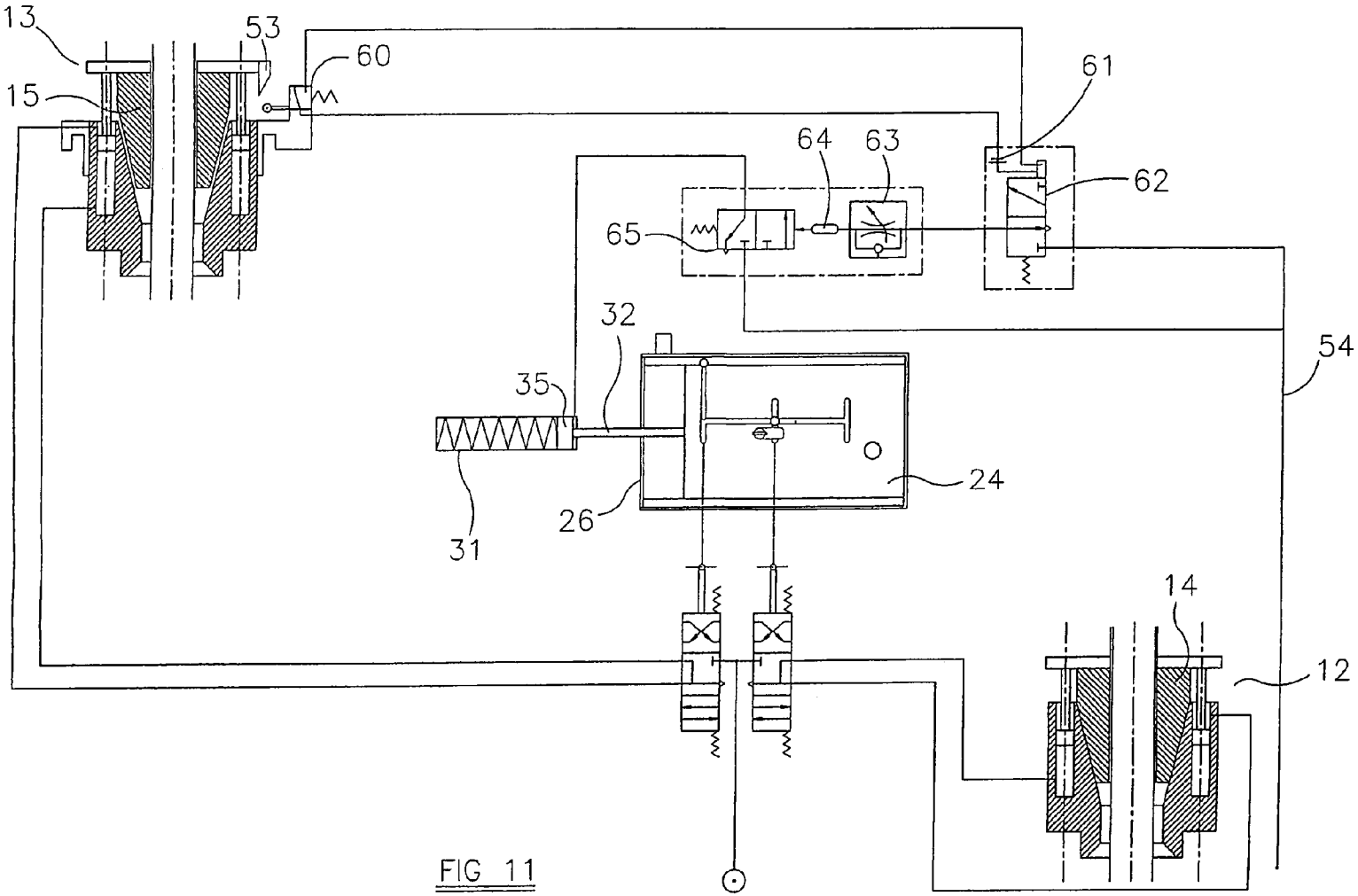
FIG. 11 illustrates schematically a further modified system for controlling the elevator and spider of the arrangement of FIG. 1.

FIG. 11 illustrates a further control system for controlling an elevator and spider arrangement such as has been described with reference to FIGS. 1 to 3. In this arrangement, the contact member 53, coupled to the elevator slips 15, is arranged to open and close an electrical switch 60. The electrical switch 60 forms part of a circuit comprising a battery 61 and an electrically controlled valve 62. When the elevator slips 15 are in the raised position, the contact member 53 is out of contact with the switch 60, and the switch 60 is in the open position. The electrical circuit comprising the switch 60 therefore remains open and no electric power is supplied to the control input of the valve 62. However, when the elevator slips 15 are correctly lowered, the contact member 53 closes the switch 60 such that the battery 61 is coupled to the control input of the valve 62. This supply of power to the valve input causes the valve to close, connecting the supply line 54 to the input of a delay circuit having at its input a one way flow regulator 63. As with the embodiment described with reference to FIG. 8, the output from the flow regulator 63 is provided to the input of an accumulator 64.

When the pressure in the accumulator 64 reaches a predefined level, the pressure causes a valve switch 65 to move from a closed position in which no compressed air is passed from the supply line 54 to the piston head of the piston 35, to an open position in which compressed air is provided to the piston head. Therefore, when the elevator slips 15 are raised (or are jammed at an intermediate position), the piston 35 remains in its fully extended position, locking the guide plate 24 in its rightmost position. However, when the elevator slips 15 are correctly lowered, the piston 30 is withdrawn within the cylinder 29 and movement of the guide plate 24 is allowed.

With reference to FIG. 12*a*, there is illustrated a spider 102 having a set of slips 104, and an elevator 103 having a set of slips 105, with the slips 104, 105 of the spider 102 and elevator 103 being raised and lowered by respective hydraulically operated piston and cylinder arrangements 106, 107. As with the embodiment of FIG. 4, pressurised fluid is supplied to the piston arrangement 106 of the spider 102 via a spider control valve 108 and supply line 109, with pressurised fluid being supplied to the piston and cylinder arrangement 107 of the elevator 103 via an elevator control valve 120 and supply lines 121.

Each of the control valves 108, 120 comprises a cylindrical top plate 122, 123 and a cylindrical body member 124, 125 depending from the top plate. Both the top plate and the cylindrical body are rotatable together about their longitudinal axes, within the valve housing 126. As can be seen in FIG. 12, each of the top plates 122, 123 has an arcuate cut out section for receiving a part of the other cylindrical plate when both plates are in a given orientation. Levers 127, 128 extend from the plates and project through the housing 126 to facilitate rotation of the valves.

Each of the valve cylinders 124, 125 is arranged to rotate a ball member within a spherical socket formed in the valve housing. Each ball member has two bores extending through it in a transverse plane. The bores are arranged to couple fluid flow lines (leading to the piston and cylinder arrangements 106, 107 and slip closure sensors to be described below) to a source of pressurised hydraulic fluid P and to a tank for draining fluid. The advantage of the particular valve arrangement described here is that it can handle both air (pneumatic) and hydraulic fluid without leakage, although only the use of hydraulic fluid is described here.

The spider 102 and elevator 103 are provided with respective slip closure sensors 129, 130. Considering the spider slip closure sensor 129, this comprises a piston and cylinder arrangement, with a rod 131 extending from the piston head 132 being in contact with associated slips 104. When the spider slips 104 are open, the piston is extended whilst when the slips are fully closed the piston is compressed within the cylinder. Hydraulic fluid flow lines 133, 134 are coupled to the cylinder in front of and behind the piston head. The hydraulic lines 133,134 are coupled to a piston driven locking mechanism 135, in front of and behind the piston head of that mechanism. When the spider slips 104 are moved from the open to the fully closed position, fluid is expelled from the bottom of the cylinder of sensor 129, through the line 134, causing a rod 136 of the locking mechanism 135 to be retracted into the cylinder. Fluid expelled from the cylinder of the mechanism 135 flows through line 133 into the top of the cylinder of the sensor 129. The elevator slip closure sensor 130 operates in a similar manner to control a locking rod 137 of a locking mechanism 138. It will be understood from FIG. 4 that the locking rods 136 and 137 are effective to prevent or allow rotation of the elevator and spider control valves respectively.

The operation of the system of FIG. 12*a* will now be described. In the configuration illustrated in the Figure, the control valves 108, 120 are oriented such that the elevator slips 105 are closed and the spider slips 104 are open. This results in the locking rod 137 locking the spider control valve 108 in place, with the locking rod 136 being disengaged from the elevator control valve 120. Because of the position of the meshing of the valves 108, 120, the elevator control valve 120 can be rotated to a position in which pressurised fluid can be conducted to the piston and cylinder arrangement 107 to lower the elevator slips.

When the elevator slips are fully lowered, the piston of the sensor 130 is fully depressed. This in turn results in the locking rod 137 of the locking mechanism 138 being fully retracted, releasing the spider control valve 108. Because of the new location of the cut out in the cylindrical plate 123 of the elevator control valve 120, the spider control valve can now be rotated to conduct fluid to the piston and cylinder arrangement 106 to raise the spider slips 104. The raising of the spider slips 104 is detected by the sensor 129, and when the slips 104 are fully raised, the result is that the locking rod 136 is fully extended. This prevents rotation of the elevator control valve 120 to open the elevator slips 105.

At this stage, all of the weight of the tubular is taken by the elevator 102, whilst the accidental opening of the elevator slips 105 is prevented. The tubular may now be lowered through the spider 102. When the tubular is at the correct height, the spider control valve 108 can be rotated (the locking rod 137 is at this stage retracted and the valves are meshed to allow rotation of the spider control valve) to engage the spider slips 104. Both the spider and the elevator are now holding the tubular. The sensor 129 detects closure of the spider, and causes the locking rod 136 to retract, releasing the elevator control valve 120. The elevator control valve 120 can then be rotated to raise the elevator slips 105. This completes one cycle of operation.

The system of FIG. 1 has been described as using hydraulic power to raise and lower the slips, and to drive the control valve locking mechanisms. However, pneumatic power could be used for one or both of these purposes. In particular, it is envisaged that the elevator slips may be hydraulically operated, with the spider slips being pneumatically operated. With the ball valve arrangement described above, the same valve hardware may be used for both circuits.

FIG. 12*b* illustrates a control system for the apparatus of FIG. 1, and which comprises a pair of locking rods for locking respective intermeshing spider and elevator control valves. The locking rods are operated by respective single acting sensing cylinders associated with the spider and the elevator.

There is illustrated in FIG. 12*c* a further embodiment of the present invention. According to this embodiment, sensor cylinders 501,502 of the spider and elevator are connected via respective hydraulic circuits to locking rods 503,504. The locking rods are moved into and out of engagement with the guide plate (see FIG. 13) to restrict movement of the guide plate. It will be appreciated that in such an arrangement, temperature changes may adversely affect operation, i.e. temperature changes may result in the expansion and compression of fluid in the circuit (similar changes may result from changes in the operating altitude of the apparatus). To mitigate this problem, both hydraulic circuits are coupled to pressure compensation circuits 505,506.

Each pressure compensation circuit comprises a valve which is opened or closed when the corresponding slip set is opened or closed, with the valve being coupled to a reservoir (or accumulator) 507. When a valve is open and the apparatus is heating up, expanding fluid may flow through the valve from the hydraulic circuit and expands into the accumulator. In the same way, when the apparatus is cooling, fluid is sucked from the accumulator, through the valve, into the hydraulic circuit.

With reference to FIG. 13, there is illustrated a spider 201 having a set of slips 202, and an elevator 203 having a set of slips 204. The spider and elevator each have a construction which is similar to that illustrated in FIGS. 2 and 3. More particularly, the slips of the spider and elevator are raised and lowered by respective pneumatically operated piston and cylinder arrangements 205,206. Pressurised air is supplied to the piston arrangement of the spider via a spider control valve 207 and supply lines. Similarly, Pressurised fluid is supplied to the piston and cylinder arrangement of the elevator via an elevator control valve 208 and supply lines.

Both the spider control valve and the elevator control valve are operated by respective levers 209,210. In order to close a set of slips which are currently in the release position, the lever of the corresponding control valve is moved to a "close" position. Similarly, in order to open a set of slips currently in a closed position, the corresponding lever is moved to an "open" position. In the arrangement shown in FIG. 13, the close position for the control valves is the uppermost position of the respective levers, whilst the open position is the lowermost position of the levers.

In order to control the operation of the levers 209,210, the control valves are mounted directly beneath a guide plate 211 (in the schematic illustration of FIG. 13, the control valves and levers are shown displaced from the guide plate for the sake of clarity). The guide plate 211 has a series of slots 212 machined into it. The slots define the various positions to which a lever can be moved during certain stages of a pipe handling process. The guide plate is slidably mounted within a box (not shown) which contains the spider and elevator control valves. The guide plate can be slid between a first rightmost position to a second leftmost position, providing that both levers are in the close positions (and that the guide plate is not otherwise locked—see below).

In the first operational position, the elevator control valve lever 210 can be moved between both the open and close positions, whilst the spider control valve lever 209 is held in the closed position. In the second operational position of the guide plate 211, the elevator control valve lever must remain in the close position, whilst the spider control valve lever may be moved between the open and close positions.

Sensor arrangements 213,214 are coupled to each of the spider and the elevator. These may be electrical, optical sensors, etc, and are arranged to detect when the slips of the spider and elevator are in the open and the closed positions. Both sensor arrangements are electrically coupled to a PLC 215. The PLC contains logic for analysing the outputs of the sensors and controlling a pair of locking rods 216,217 accordingly. The locking rods may be driven by solenoids in response to control signals generated by the PLC, and are arranged to lock the guide plate in either its leftmost or rightmost position. When the PLC detects that the slips of the spider are closed, the rightmost locking rod is withdrawn, allowing the guide plate to be slid to the right, thus releasing the lever controlling the elevator slips (in this position, the left most locking rod snaps back into a locking position). This lever can then be moved to open the elevator slips. Similarly, when the elevator slips are subsequently closed (after for example the connection of a further tubular to a string), the left most locking rod is withdrawn, allowing the guide plate to be slid to the left, releasing the spider slip control lever which can be moved to open the spider slips. The right most locking rod has by this time snapped back to the locking position.

FIG. 14 illustrates a modification to the system of FIG. 13. In this modified arrangement, the electrical/optical sensors for sensing opening and closing of the slips are replaced by stroke sensors 300,301 located in the slip cylinders 302,303. Yet another modified design is illustrated in FIG. 15. In this arrangement, a locking rod 400,401 is associated with each of the spider and elevator slip control valves. Each locking valve is driven by a solenoid electrically coupled to the PLC 402. The PLC monitors the open/closed (and/or correct gripping) status of the slips and shifts the locking rods accordingly.

The stroke measurement can be used to monitor slip movement while taking over the string load to analyse the performance of the actual grip, i.e. as a quality control measurement.

It will be appreciated by the person of skill in the art that various modifications may be made to the above described embodiment without departing from the scope of the present invention.

The invention claimed is:

1. Apparatus for gripping and releasing a tubular, the apparatus comprising:

an elevator having slips for gripping and releasing the tubular;

a spider having slips for gripping and releasing the tubular;

a valve for directly controlling a supply of pressurized fluid to move the spider slips between a gripping position and a release position, wherein the valve is operated by a lever; and a guide plate, the guide plate moveable between a first position in which the guide plate prevents movement of the lever to open the valve and a second position in which the guide plate allows movement of the lever to open the valve, and wherein movement of the guide plate from the first position to the second position is prevented if the elevator slips are not correctly closed.

2. Apparatus according to claim 1, wherein said valve for directly controlling the supply of pressurized fluid to move the spider slips is a mechanically operated valve which is operated manually.

3. Apparatus according to claim 1, wherein the lever projects through the guide plate.

4. Apparatus according to claim 1 and comprising an additional user operable locking means for preventing accidental movement of the guide plate between the first and second positions.

5. Apparatus according to claim 1 and comprising a mechanically operated valve for controlling the supply of pressurized fluid to move the elevator slips between a gripping position and a release position, the valve being operated by a lever which also projects through said guide plate such that when the guide plate is in its first position, the lever may be moved to open the elevator slips. whilst when the guide plate is in its second position, movement of the lever to open the elevator slips is prevented.

6. A method of gripping and releasing a tubular, the method comprising the steps of:

gripping the tubular with a with a first gripper;

actuating a second gripper to grip the tubular;

locking a manual control member of the second gripper to prevent releasing the tubular;

operating the control member; and releasing the first gripper from the tubular.

7. The method of claim 6, further comprising prohibiting movement of a guide plate to a position to move the lever if the elevator slips are not gripping the tubular.

8. The apparatus of claim 6, wherein the manual control is one or more levers.

9. The apparatus of claim 6, wherein the manual control is one or more buttons.

10. Apparatus for gripping and releasing a tubular, the apparatus comprising:

an elevator having slips for gripping and releasing the tubular;

a spider having slips for gripping and releasing the tubular;

a first valve for directly controlling a supply of pressurized fluid to move the spider slips between a gripping position and a release position;

a second valve for directly controlling a supply of pressurized fluid to move the elevator slips between a gripping position and a release position, and said first and second valves being meshed together in order to mechanically inhibit movement of said first valve to a position in which the spider slips release the tubular when the elevator slips are not in a gripping position.

11. Apparatus according to claim 10, wherein the first and second valves are capable of controlling the flow of pressurized air and hydraulic fluid.

12. Apparatus according to claim 11, wherein the first and second valves are ball valves.

13. Apparatus according to claim 12, wherein the means for mechanically inhibiting movement of the spider slips control valve further comprises sensor means for detecting when the elevator slips are in the correct gripping position, the sensor means being coupled to a mechanism for locking said first valve in the first position when the elevator slips are detected to be open, thus preventing rotation of the first valve from the first to the second position, and the release of the second valve.

14. Apparatus according to claim 13 and comprising second sensor means for detecting when the spider slips are in the correct gripping position, the second sensor means being coupled to a mechanism for mechanically locking the second valve in the first position when the spider slips are detected to be open, thus preventing rotation of the second valve from the first to the second position, and the release of the first valve.

15. Apparatus according to claim 14, wherein the first and second sensor means comprise respective piston and cylinder arrangements arranged beneath the slips of the elevator and spider and each piston and cylinder arrangement is coupled hydraulically or pneumatically to the corresponding locking mechanism.

16. Apparatus according to claim 15, wherein each locking mechanism comprises a hydraulically or pneumatically operate locking rod which is moveable between a position in which the rod engages the corresponding valve and a position in which the rod is disengaged from that valve.

17. Apparatus according to claim 10, wherein the first and second valves can be rotated between a first position in which the associated set of slips is caused to be closed and a second position in which the associated set of slips is caused to be open.

18. Apparatus according to claim 17, wherein the meshing of the valves results in the locking of the first valve in the first position, when the second valve is in the second position, and the release of the first valve when the second valve is rotated from the second to the first position.

19. Apparatus according to claim 18, wherein the meshing of the valves results in the locking of the second valve in the first position, when the first valve is in the second position, and the release of the second valve when the first valve is rotated from the second to the first position.

20. Apparatus according to claim 19, wherein the first and second valves each comprise a substantially cylindrical body member rotatable around its longitudinal axis, each cylindrical body having an arcuate section cut away, and the cylindrical bodies being arranged co-axially so that when the first valve is located in the first position, and the second valve is located in the second position, part of the second valve is located in the cut away of the valve, and vice versa when the first valve is located in the second position and the second valve is located in the first position.

21. Apparatus according to claim 10, and comprising a mechanical link coupling the elevator slips to the means for mechanically inhibiting movement of the spider control valve.

22. Apparatus for gripping and releasing a tubular, the apparatus comprising:

an elevator having slips for gripping and releasing the tubular;

a spider having slips for gripping and releasing the tubular;

a valve for directly controlling a supply of pressurized fluid to move the spider slips between a gripping position and a release position;

means for mechanically inhibiting movement of said valve to a position in which the spider slips release the tubular, when the elevator slips are not in a gripping position; and a sensor for detecting the elevator slips are in the correct gripping position, the sensor being coupled to said means for mechanically inhibiting movement of the spider control valve, the sensor comprising a switch which is moved from a first position to a second position when the elevator slips are moved to the correct closed position, and wherein when the switch is in the first position, movement of a guide plate from its first to its second position is prevented, and when the switch is in the second position, movement of the guide plate from its first to its second position is possible.

23. Apparatus according to claim 22, wherein the sensor comprises a piston and cylinder arrangement coupled between the main body and the slips of the elevator, the piston and cylinder arrangement is coupled hydraulically to said means for mechanically inhibiting movement.

24. Apparatus according to claim 22, wherein the switch controls the supply of pressurized fluid to a piston and cylinder arrangement, the piston of which locks the guide plate in its first position when the supply of pressurized fluid to the cylinder is prevented, and releases the guide plate when the supply of pressurized fluid to the cylinder is allowed.

25. Apparatus according to claim 24, wherein said switch is arranged to directly open and close a hydraulic or pneumatic circuit.

26. Apparatus according to claim 24, wherein the switch forms part of an electrical circuit which is arranged to open and close a hydraulic or pneumatic circuit.

27. An apparatus for gripping and releasing a tubular, the apparatus comprising:

an elevator having slips for gripping and releasing the tubular;

a spider having slips for gripping and releasing the tubular;

a valve for directly controlling a supply of pressurized fluid to move the spider slips between a gripping position and a release position; and a piston and cylinder arrangement for mechanically inhibiting movement of the valve to a position in which the spider slips release the tubular, when the elevator slips are not in a gripping position, wherein the piston and cylinder comprise a circuit coupling an elevator control valve to a piston and cylinder arrangement for opening and closing the elevator slips, and wherein the first mentioned piston and cylinder arrangement is located between the piston and cylinder arrangement for moving the slips and the elevator control valve such that a rod of the first mentioned piston and cylinder arrangement is displaced by the flow of fluid in the circuit to inhibit or allow movement of the spider control valve.

28. The apparatus of claim 27 wherein the circuit is a hydraulic circuit.

29. The apparatus of claim 27 wherein the circuit is a pneumatic circuit.

30. An apparatus for gripping and releasing a tubular, the apparatus comprising:

a first gripping member for gripping the tubular;

a second gripping member for gripping the tubular;

a manual control for operating at least one of the gripping members; and a locking member for inhibiting the movement of the control.

31. The apparatus of claim 30, wherein the manual control is one or more levers.

32. The apparatus of claim 30, wherein the inhibiting locking member is a guide plate.

33. The apparatus of claim 30, wherein the locking member is a first and second valve meshed together.

34. The apparatus of claim 30, wherein the manual control is one or more buttons.

* * * * *

UNITED STATES PATENT AND TRADEMARK OFFICE

CERTIFICATE OF CORRECTION

PATENT NO. : 7,086,461 B2
APPLICATION NO. : 10/399998
DATED : August 8, 2006
INVENTOR(S) : Schulze-Beckinghausen et al.

It is certified that error appears in the above-identified patent and that said Letters Patent is hereby corrected as shown below:

In the Claims:

In Column 15, Claim 6, Line 44, please delete "with a with a first gripper" and insert --with a first gripper--;

In Column 18, Claim 32, Line 36, please delete "inhibiting".

Signed and Sealed this

Tenth Day of July, 2007

JON W. DUDAS
*Director of the United States Patent and Trademark Office*